United States Patent [19]

Dahlman et al.

[11] 4,111,024

[45] Sep. 5, 1978

[54] PRESSING TOOL STRUCTURE FOR SHEET METAL FORMING

[75] Inventors: Goran Dahlman, Sundsvall; Jan-Erik Carlsson, Helsingborg, both of Sweden

[73] Assignee: ASEA Aktiebolag, Vesteras, Sweden

[21] Appl. No.: 782,161

[22] Filed: Mar. 28, 1977

[30] Foreign Application Priority Data

Apr. 8, 1976 [SE] Sweden ..... 7604117

[51] Int. Cl.[2] ..... B21D 22/10

[52] U.S. Cl. ..... 72/60; 72/465; 72/DIG. 14; 100/211

[58] Field of Search ..... 72/60, 465, 466, DIG. 14; 29/421 R; 100/211; 10/24

[56] References Cited

U.S. PATENT DOCUMENTS

| | | | |
|---|---|---|---|
| 2,966,873 | 1/1961 | Hoffman et al. | 72/466 X |
| 3,937,053 | 2/1976 | Okamatsu | 10/24 X |

FOREIGN PATENT DOCUMENTS

| | | | |
|---|---|---|---|
| 220,766 | 8/1924 | United Kingdom | 72/465 |
| 198,280 | 12/1967 | U.S.S.R. | 72/465 |

*Primary Examiner*—Leon Gilden

*Attorney, Agent, or Firm*—Watson, Cole, Grindle & Watson

[57] ABSTRACT

A pressing tool for use in the cavity of a press device for forming sheet metal parts around forming tools, the pressing tool including an upper tool part with flanges at the peripheral edges thereof and directed downwardly, a lower tool part with flanges at the peripheral edges thereof and directed upwardly, wall elements positioned within the respective flanges of the upper and lower tool parts to form a forming space, a forming tool positioned in the space on the lower tool part, and an elastomeric forming pad located in the forming space for forming a work piece around the forming tool.

8 Claims, 8 Drawing Figures

PRESSING TOOL STRUCTURE FOR SHEET METAL FORMING

BACKGROUND OF THE INVENTION

1. Field of the Invention

The present invention relates to presses, and more specifically to pressing tool structures used in press devices for the shaping sheet metal parts, which pressing tools employ elastomeric forming pads for the forming of the sheet metal parts around forming tools.

2. Description of the Prior Art

Press devices for the deformation of sheet metal parts around forming tools and which employ elastomeric forming pads for the application of pressure to the sheet metal parts are known in the art. Such elastomeric forming pads can be used to apply pressure to all sides of the sheet metal parts, and normally these elastomeric forming pads, as well as the sheet metal parts and the forming tools, are located in cavities within the press devices. The pressing force is achieved by placing a "pressing tool" within the cavity of the press device, this pressing tool including an upper tool part, a lower tool part, and the elastomeric forming pad in the forming space therebetween, and then moving the upper tool part down onto the lower tool part which itself is in supporting relationship to the forming tool(s) and the sheet metal part(s) to be shaped. Once the upper tool part has moved downwardly a certain distance, the elastomeric forming pad will completely fill the space in which the forming tool and sheet metal part are positioned, and further movement of the upper tool part will then result in a sharp increase in the pressure within the elastomeric forming pad. Of course, this pressure acts in all directions, generally in the same way as a pressure from within a contained liquid. The forming pad then will press the sheet metal part (work piece) against the forming tool so that the work piece assumes the shape of the forming tool. The great advantages of these types of prior art presses is that the forming pressures can be made very high, e.g. 1000 bar or more, and also that the production capacity can be made very high.

In most cases a rectangular cross-section of the forming space is most practical, both with regard to the utilization of the working space of the press device and with regard to the dimensions of normal work pieces. At the same time, the difficulty and the cost of manufacturing large pressing tools having upper and/or lower parts with a rectangular space for the forming pad increases with the working pressure and the depth of the space. However, a thick forming pad and a large depth in the upper or lower tool part containing the forming pad are required when work pieces with long flanges are to be produced. The stresses at the inner corners of the space will be great and difficult to control due to the bending caused by the outwardly-directed forces from the forming pad. The recesses at the intersection zones between the roof and walls defining the space result in a very unfavorable stress configuration which then necessitates use of undesirable shapes with large recesses and thick walls. All these measures will encroach upon the useful space. The cost of manufacturing forgings increases rapidly with increased size, and the removal of large amounts of material for making room for the forming pad is time-wasting and expensive.

Accordingly, it is an object of the present invention to produce a pressing tool which is constructed to avoid the aforementioned drawbacks.

SUMMARY OF THE INVENTION

According to the present invention, a pressing tool of the general type mentioned is constructed in an entirely new way. The press tool structure which forms the space enclosing the forming pad and the forming tool with work pieces comprises an upper tool portion which includes a plate with downwardly-directed flanges at the peripheral edges and a number of separately downwardly-directed wall elements. These wall elements are suspended from the plate and are supported by the flanges of the plate which take up outwardly directed forces caused by the pressure in the forming pad during the pressing operation. The press tool further comprises a lower tool portion including a plate having upwardly-directed flanges supporting the wall elements and which take up outwardly-directed forces when the upper and lower tool portions approach each other during the pressing operation and when a pressure is generated in the forming pad. To reduce the stresses in the plates with the force-absorbing flanges, the plates or supporting members in the press for the plates may be constructed so that the tensile stresses in the most dangerous cross-section, with regard to stress concentrations, are reduced so that reduced dimensions or increased life can be achieved. A plate or a support member in the press therefor is designed so that the contact pressure between the plate and its support member becomes greater at the periphery of the plate than at its inner parts during the forming stage. This varying contact pressure can be achieved by constructing one tool part and its support member in such a way that, in the case of the unloaded tool, contact is effected only along the peripheral edge of the tool part and such that a gap exists inside the contact surface at the peripheral edge. The tool part or the support member can be formed, for example, with a cup-shaped surface.

Further objects, advantages, and features of the invention will be apparent in the arrangement and construction of the constituent parts in detail as set forth in the following specification taken together with the accompanying drawings.

DETAILED DESCRIPTION OF THE PREFERRED EMBODIMENTS

Figure 1:
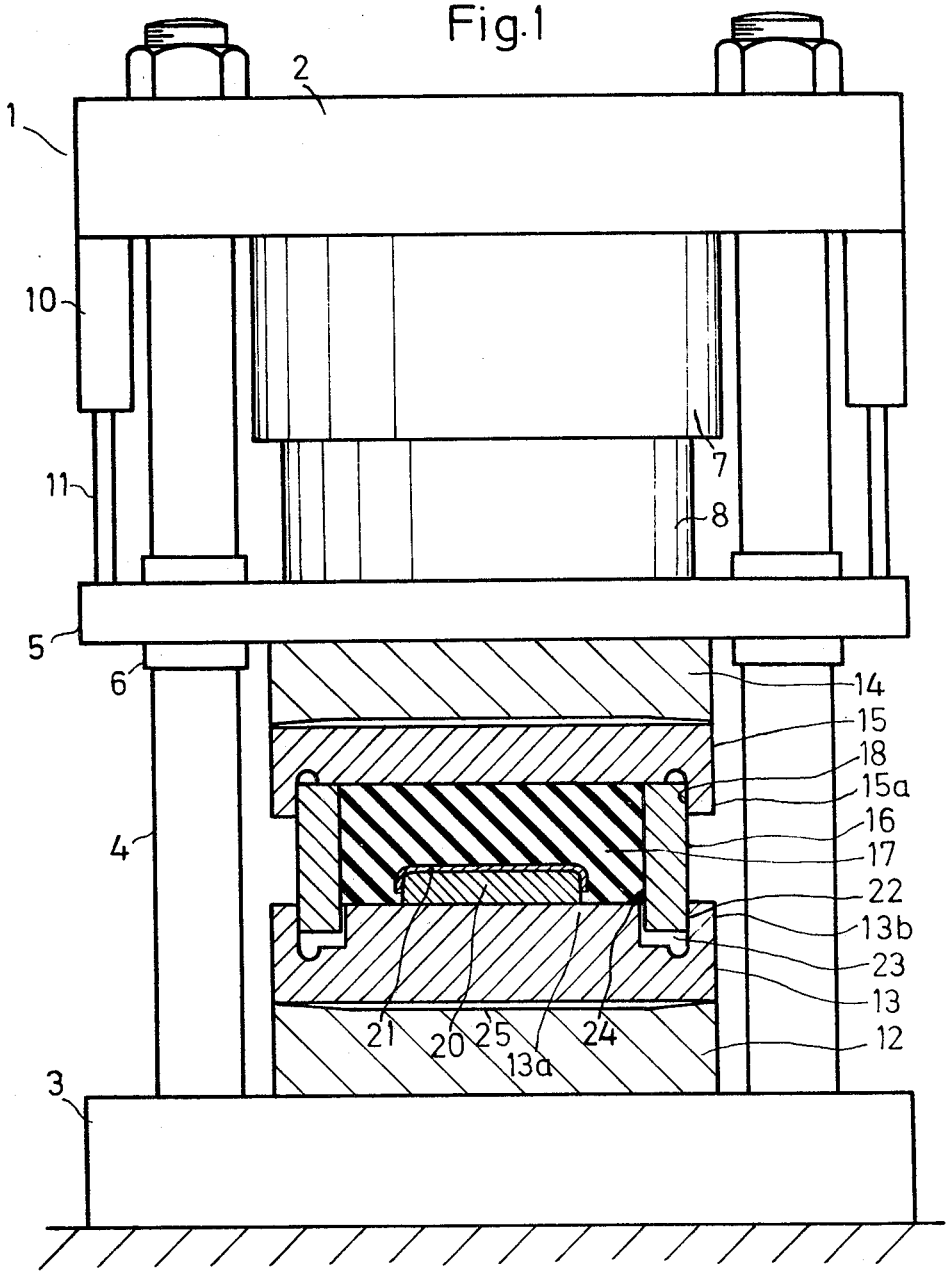
FIG. 1 shows in schematic representation a press device according to the present invention, a section being taken through the immediately cooperating parts of the pressing tool portion thereof.

Referring to the Figures, wherein like numerals represent like parts, a press device, generally indicated by stand 1 is shown (FIG. 1) which includes an upper yoke 2, a lower yoke 3, and draw bars 4 which hold the yokes together. Positioned in the press stand is a vertically movable pressing tool holder 5 with guides 6 which run along the draw bars 4 of the press stand. Attached to the upper yoke 2 of the press stand is a cylinder 7 with a piston 8 which is joined to the tool holder 5 and is intended to move the tool holder downward and effect the press force. To raise the tool holder 5, there are a number of air cylinders 10 which are attached to the upper yoke 2 and are joined to the tool holder 5 by draw bars 11.

Figure 2:
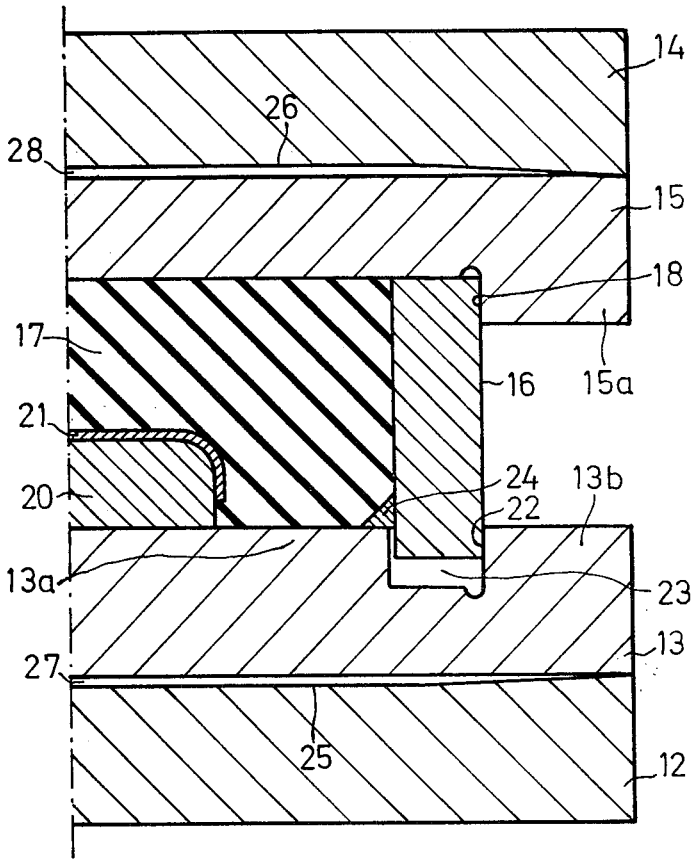
FIG. 2 shows on an enlarged scale a section through a part of the pressing tool shown in FIG. 1.

On the lower yoke 3 is located a lower plate 12 which acts as a support for lower plate-shaped tool part 13. Suspended from the tool holder 5 is an upper plate 14 which acts as a support for an upper plate-shaped tool part 15. This tool part 15 is suspended from upper plate 14, and includes flanges 15*a* with supporting surfaces 18 which can take up outwardly directed forces thereagainst. Within the tool part 15 are positioned walls 16 which themselves enclose a forming pad 17. The lower tool part 13 is composed of a central portion 13*a*, on which a forming tool 20 for a plate 21 is placed, and flanges 13*b* which have supporting surfaces 22 which take up outwardly-directed forces from the walls 16 which are positioned in slots 23 located between part 13*a* and the flanges 13*b*. These walls 16 move down within slots 23 during the pressing operation. At the lower corner of the pressing space there are located strips 24 bridging a necessary gap between the tool part 13*a* and the walls 16 so that the material in the forming pad 17 is pressed out. The lower and upper support plates 12 and 14, which take up forces from the lower and upper tool parts 13 and 15, are formed with cup-shaped surfaces 25 and 26 (see FIG. 2), respectively, so that when plates 12 and 14 are unloaded, contact results only along the peripheral edges of the plates. Gaps 27 and 28, respectively, are thus formed inside the contact surfaces.

Figure 3:
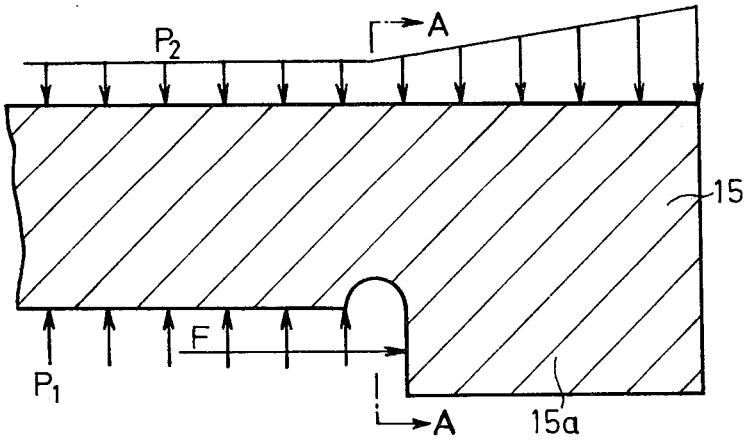
FIG. 3 shows a representation of the lead forces on an upper plate of the pressing tool shown in FIG. 1.
Figure 4:
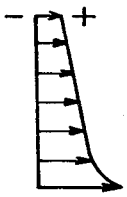
FIGS. 4–6 the stress forces which occur along section A—A of FIG. 3.
Figure 5:
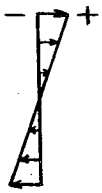
Figure 6:
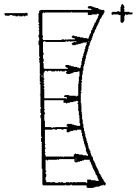

FIG. 3 represents how the upper tool part 15 is loaded when the inventive press is operated. The walls 16 will exert pressure against the flanges 15*a* as by forces F. The forming pad 17 will exert a pressure, as shown by $P_1$, on the adjacent inner surface of the upper tool part 15. A pressure $P_2$ will be exerted on the upper surface of the upper tool part 15, which pressure will increase towards the peripheral edge of the part 15. Along the section line A—A from the bottom to the top, the forces F will provide a stress which, in principle, will vary as illustrated in FIGS. 4–6. At the lowermost part of the section, the stress will increase greatly because of the effect of the recess as the corner as shown in FIG. 4. Because the inventive structure will cause the distribution of the pressure $P_2$ as illustrated in FIG. 3, a bending moment is obtained which, moving upward along section A—A, will result in a stress configuration of the type as shown in FIG. 5. A resulting stress of the type as shown in FIG. 6 is then obtained at the uppermost part of section A—A. As is clear from the Figures, the detrimental stress at the recesses at the lower part of the section is thus considerably reduced.

Figure 7:
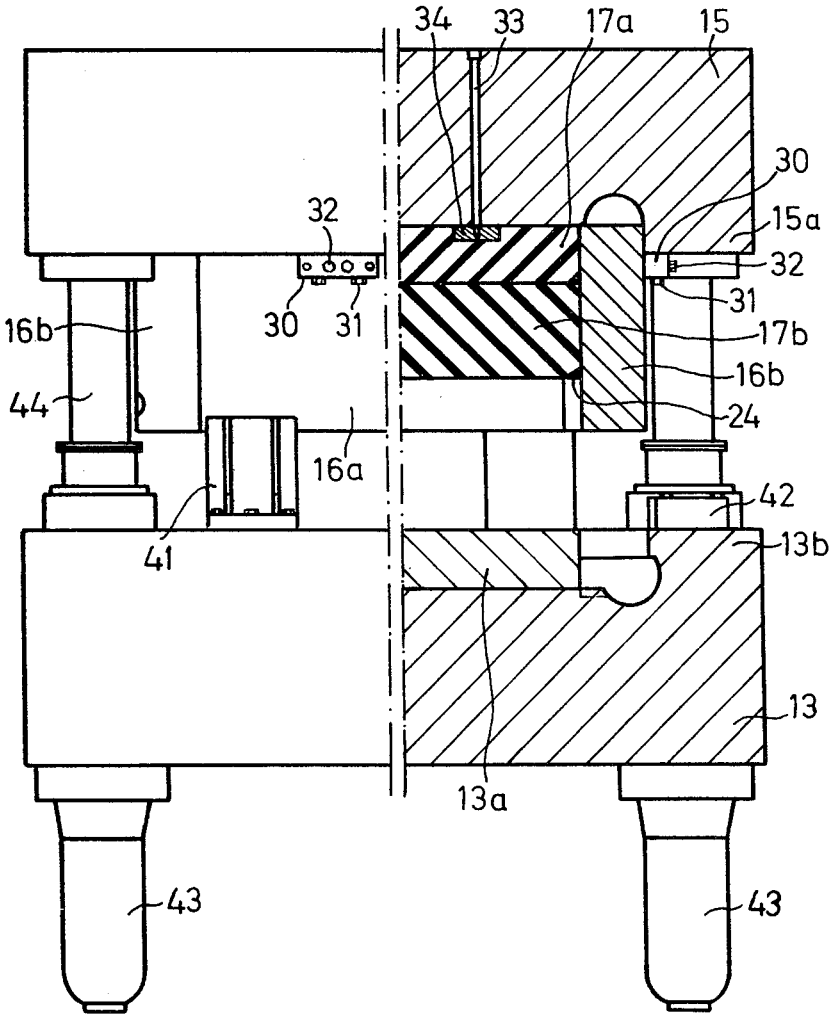
FIGS. 7 and 8 show in more detail a further embodiment of a pressing tool according to the present invention.
Figure 8:
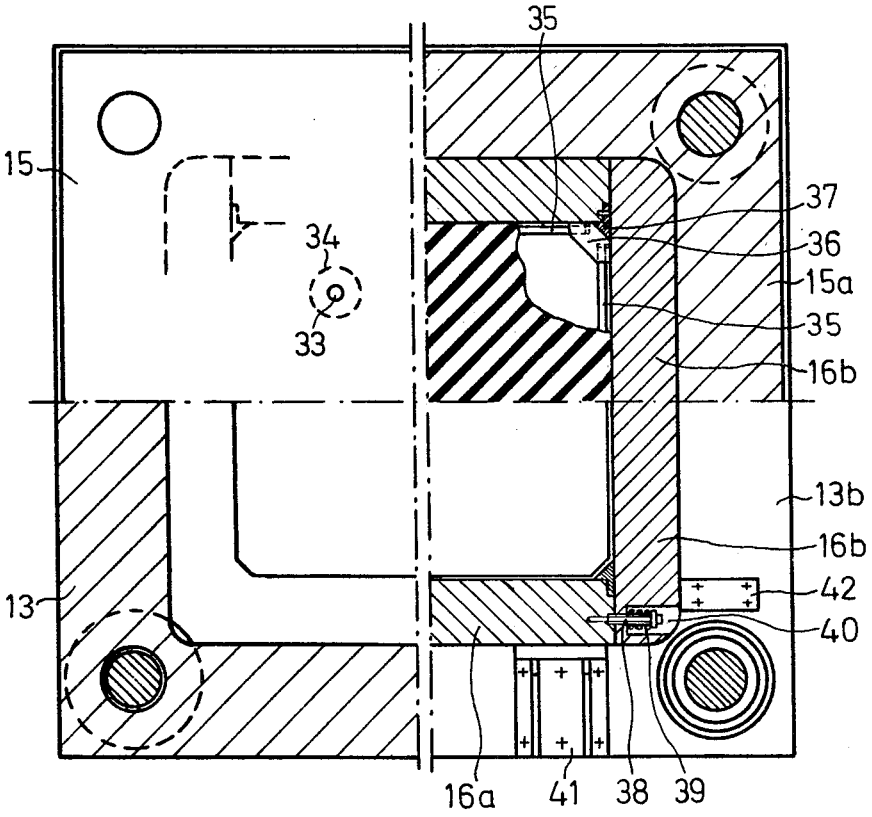

FIG. 7 shows partly a view and partly a section through a pressing tool according to another embodiment of the present invention with lifting cylinders for the upper tool part, and FIG. 8 shows a view and three sections, respectively, which are taken at the levels indicated in FIG. 7.

In these Figures, side walls 16*a* and the end walls 16*b* are suspended from the flange 15*a* of the upper plate 15 by means of a number of blocks 30 and bolts 31 and 32 joining the blocks with the flange 15*a* of plate 15 and with walls 16*a* and 16*b*, respectively. The rubber pad 17 consists of two layers 17*a* and 17*b*. The pad is attached to the plate 15 by means of a number of bolts 33 which are screwed into plates 34 which are fixed by vulcanization to the upper layer 17*a* of the pad. Around the pad there is an upper strip 35 with corner plates 36 preventing the pad 17 from being pressed out between plate 15 and walls 16*a* and 16*b*. At the corners of the walls there are vertical strips 37 preventing the pad 17 from being pressed out between walls 16*a* and 16*b*. The walls 16*a* and 16*b* are held together by bolts 38 and a pack of springs 39 in the bores 40 at the end walls 16*b*, thus resulting in a certain degree of movability. The central part 13*a* of the lower plate, on which the tool and the work piece rest, consists of a separate plate. Guides 41 and 42 for the side walls 16*a* and end walls 16*b* are attached to the flange 13*b* of the lower plate 13.

The pressing tool is constructed with four air cylinders 42 for lifting the upper tool part. The cylinders are attached to the lower plate 13. The plate 15 of the upper tool part rests on the piston rods 44.

We claim:

1. In a pressing tool for forming work pieces around forming tools, the pressing tool including an upper tool part, a lower tool part and an elastomeric forming pad in the space between the upper tool part and the lower tool part, at least one of the upper tool part and the lower tool part being movable toward the other tool part, the improvement wherein:

the upper tool part comprises an upper plate with flanges at the peripheral edges thereof directed downwardly;

the lower tool part comprises a lower plate with flanges at the periperal edges thereof directed upwardly; and a number of separate wall elements positioned between the upper tool part and the lower tool part, said wall elements being positioned in the space between said upper tool part and said lower tool part and supported at the ends thereof inwardly of said flanges on said upper plate and the flanges of said lower plate when the upper and lower tool parts approach each other during a pressing operation.

2. The press tool according to claim 1, wherein said upper and lower plates are supported, respectively, by upper and lower support members, said upper support member being positioned adjacent said upper plate on the side opposite the side thereof from which said flanges extend, said lower support member being positioned adjacent said lower plate on the side opposite the side thereof from which said flanges extend, each of said upper and lower support members being constructed such that the pressure exertable against said upper and lower tool part, respectively, being greater at the peripheral edges thereof than at the inner parts during a pressing operation.

3. The press tool according to claim 2, wherein the surfaces of the upper and lower tool parts and the surfaces of the upper and lower supporting members which are in respective facing positioning are constructed such that a gap is created inside the contacting peripheral edges when a pressing operation is not in operation.

4. The press tool according to claim 3, wherein the surfaces of the upper and lower tool parts or the surfaces of the upper and lower supporting members which are in respective facing positioning are cup-shaped.

5. The press tool according to claim 1, wherein said upper and lower plates and said wall elements are of a generally rectangular cross-section.

6. The press tool according to claim 1, wherein the improvement includes an upper strip means positioned between the forming pad and the adjacent intersection zones between the upper plate and the wall elements in order to prevent the forming pad from being pressed out between the upper plate and the wall elements during a pressing operation.

7. The press tool according to claim 1, wherein said elastomeric forming pad is composed of rubber.

8. The press tool according to claim 1, wherein said wall elements have a rectangular, box-like configuration.

* * * * *